US010270211B2

(12) United States Patent
Yu et al.

(10) Patent No.: US 10,270,211 B2
(45) Date of Patent: Apr. 23, 2019

(54) ELECTRICAL CONNECTOR HAVING A SHIELDING SHELL WITH A RECESSED PLATE TO DISTANCE FROM CONTACT TAILS

(71) Applicant: FOXCONN INTERCONNECT TECHNOLOGY LIMITED, Grand Cayman (KY)

(72) Inventors: Yang-Yang Yu, Huaian (CN); Jin-Guo Qiu, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/851,752

(22) Filed: Dec. 22, 2017

(65) Prior Publication Data

US 2018/0183186 A1 Jun. 28, 2018

(30) Foreign Application Priority Data

Dec. 22, 2016 (CN) ..... 2016 2 1420113 U

(51) Int. Cl.

| | |
|---|---|
| ***H01R 13/658*** | (2011.01) |
| ***H01R 13/6581*** | (2011.01) |
| ***H01R 13/6594*** | (2011.01) |
| ***H01R 12/57*** | (2011.01) |
| ***H01R 13/40*** | (2006.01) |
| ***H01R 12/58*** | (2011.01) |
| ***H01R 12/71*** | (2011.01) |
| ***H01R 13/6473*** | (2011.01) |
| ***H01R 13/6595*** | (2011.01) |

(Continued)

(52) U.S. Cl.

CPC ..... *H01R 13/6581* (2013.01); *H01R 12/57* (2013.01); *H01R 12/58* (2013.01); *H01R 12/716* (2013.01); *H01R 13/40* (2013.01); *H01R 13/6473* (2013.01); *H01R 13/6594* (2013.01); *H01R 13/6595* (2013.01); *H01R 12/724* (2013.01); *H01R 24/20* (2013.01)

(58) Field of Classification Search

CPC ..... H01R 13/6581

See application file for complete search history.

(56) References Cited

U.S. PATENT DOCUMENTS

2016/0149350 A1* 5/2016 Kao ..... H01R 12/724 439/607.05

FOREIGN PATENT DOCUMENTS

| | | |
|---|---|---|
| CN | 204304072 U | 4/2015 |
| CN | 104716505 A | 6/2015 |

(Continued)

*Primary Examiner* — Ross N Gushi

(74) *Attorney, Agent, or Firm* — Wei Te Chung; Ming Chieh Chang

(57) ABSTRACT

An electrical connector includes: a contact module including an insulative housing and an upper and lower rows of contacts arranged in the insulative housing, the insulative housing having a base and a tongue, the upper row of contacts and the lower row of contacts being exposed to two opposite surfaces of the tongue, respectively, each contact having a contacting portion, a tail, and an intermediate portion between the contacting portion and the tail; and a shielding shell enclosing the insulative housing, the shielding shell including a rear plate proximate to the contact tails; wherein the rear plate has a recessed face opposing the contact tails to increase a distance between the rear plate and the contact tails.

19 Claims, 11 Drawing Sheets

(51) Int. Cl.
*H01R 12/72* (2011.01)
*H01R 24/20* (2011.01)

(56) References Cited

FOREIGN PATENT DOCUMENTS

| | | | |
|---|---|---|---|
| CN | 204391414 | U | 6/2015 |
| TW | M499683 | U | 4/2015 |

* cited by examiner

ELECTRICAL CONNECTOR HAVING A SHIELDING SHELL WITH A RECESSED PLATE TO DISTANCE FROM CONTACT TAILS

BACKGROUND OF THE INVENTION

1. Field of the Invention

The present invention relates to an electrical connector including a contact module and a shielding shell enclosing the contact module, wherein the shielding shell includes a rear plate proximate to, but configured to suitably distance from, contact tails of the contact module.

2. Description of Related Arts

Taiwan Patent No. M499683 discloses an electrical connector including a contact module, a shielding shell enclosing the contact module, and a rear shielding plate securely fixed to an insulative housing of the contact module or welded externally to the shielding shell.

China Patent No. 204391414 discloses an electrical connector comprising an insulative housing having a base and a tongue, a shielding plate affixed to the tongue portion, and two rows of contacts at an upper side and a lower side of the shielding plate. Each row of contacts include one or more high-speed differential signal pairs. A thickness of the portion of the shielding plate opposing the high-speed differential signal pairs is reduced to increase a distance therebetween for impedance matching consideration.

SUMMARY OF THE INVENTION

An electrical connector comprises: a contact module including an insulative housing and an upper and lower rows of contacts arranged in the insulative housing, the insulative housing having a base and a tongue, the upper row of contacts and the lower row of contacts being exposed to two opposite surfaces of the tongue, respectively, each contact having a contacting portion, a tail, and an intermediate portion between the contacting portion and the tail; and a shielding shell enclosing the insulative housing, the shielding shell including a rear plate proximate to the contact tails; wherein the rear plate has a recessed face opposing the contact tails to increase a distance between the rear plate and the contact tails.

DETAILED DESCRIPTION OF THE PREFERRED EMBODIMENTS

Figure 1:
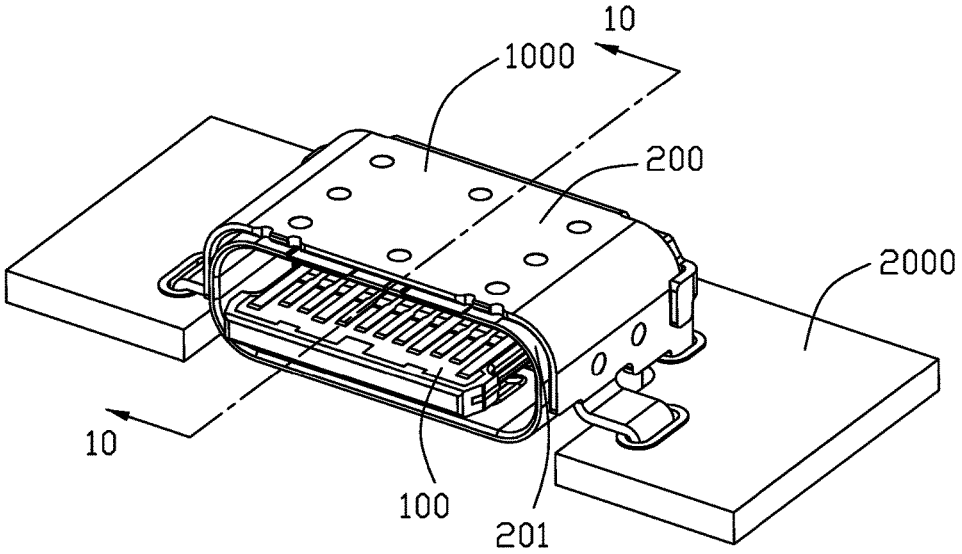
FIG. 1 is a front perspective view of an electrical connector in accordance with the present invention mounted to a printed circuit board.
Figure 1A:
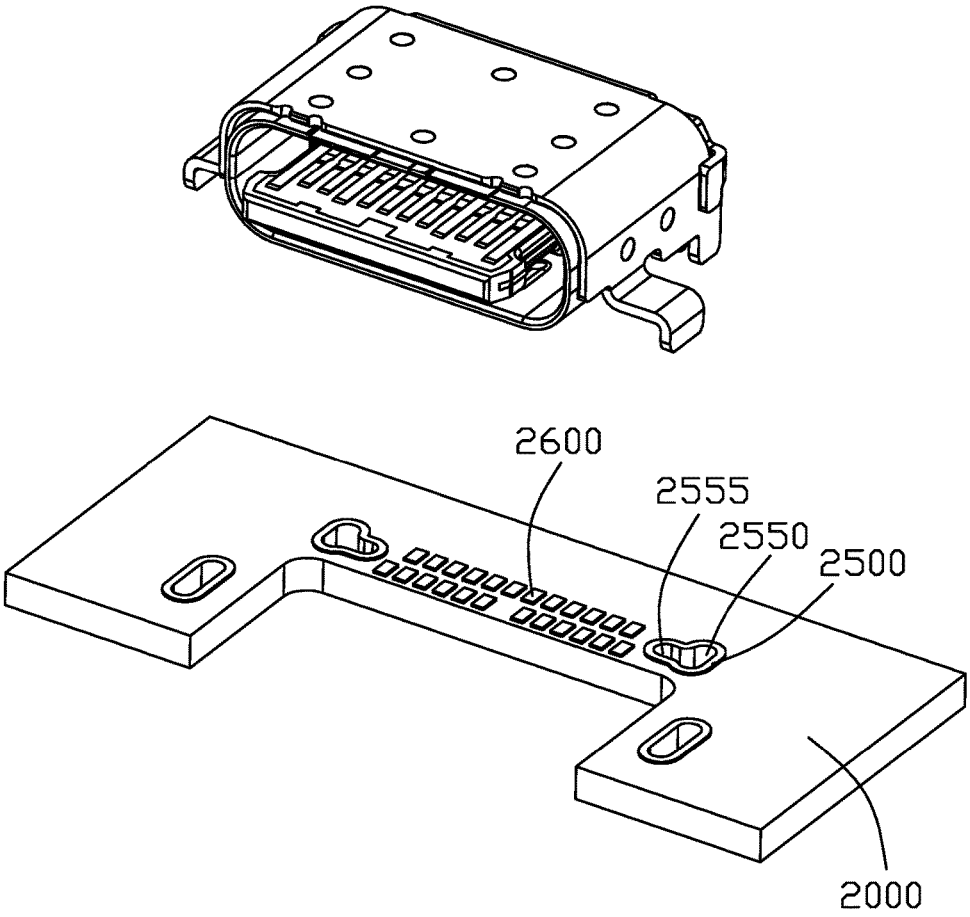
FIG. 1(A) is a front perspective view of the electrical connector removed away from the printed circuit in accordance with the present invention.

Referring to FIGS. 1(A)-10, an electrical connector 1000 for mounting to a printed circuit board 2000 includes a contact module 100 and a shielding shell 200 enclosing the contact module 100. The contact module 100 includes an insulative housing 1 and an upper and lower rows of contacts 2. The contact module 100 may further include a middle grounding plate 3 arranged between the upper and lower rows of contacts 2.

The insulative housing 1 includes a base 11 and a tongue 12. The contact 2 has a contacting portion 21, a securing portion 22, and a soldering portion or tail 23. In construction, the insulative housing 1 includes assembled first insulator 13 and second insulator 14 carrying respective contacts 2 and a third insulator 15 over-molding the first and second insulators. The first insulator 13 includes a base portion 131 and a tongue portion 132; the second insulator 14 includes a base portion 141 and a tongue portion 142; the third insulator 15 includes a base portion 151 and a tongue portion 152. Features 1311, 1312, 1411, 1412 are provided on the first and second insulators for fastening to each other. The base portions 131, 141, and 151 constitute the base 11 of the insulative housing 1; the tongue portions 132, 142, and 152 constitute the tongue 12 of the insulative housing 1. The middle grounding plate 3 if present is provided with holes 31 which cooperate with holes 133 and 143 on the first and second insulators for molding purposes.

Figure 2:
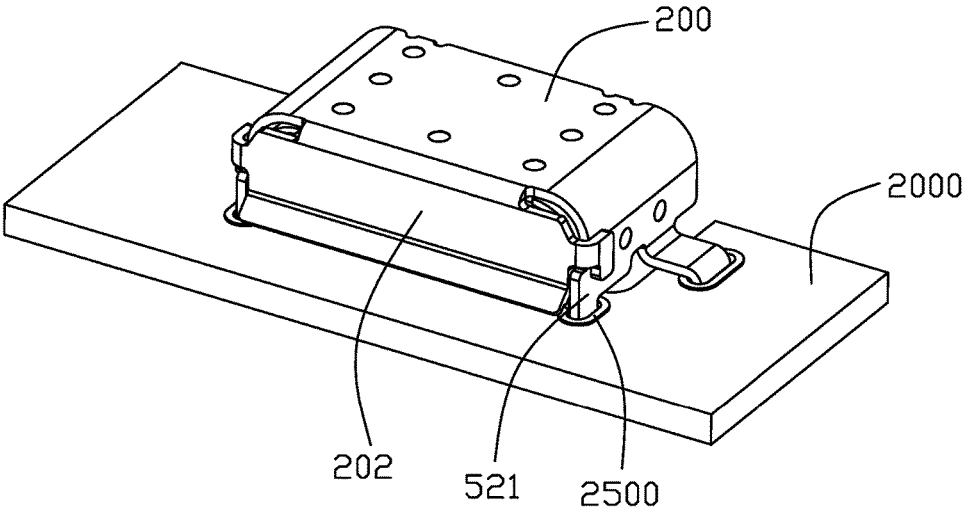
FIG. 2 is a rear perspective view of the electrical connector.
Figure 3:
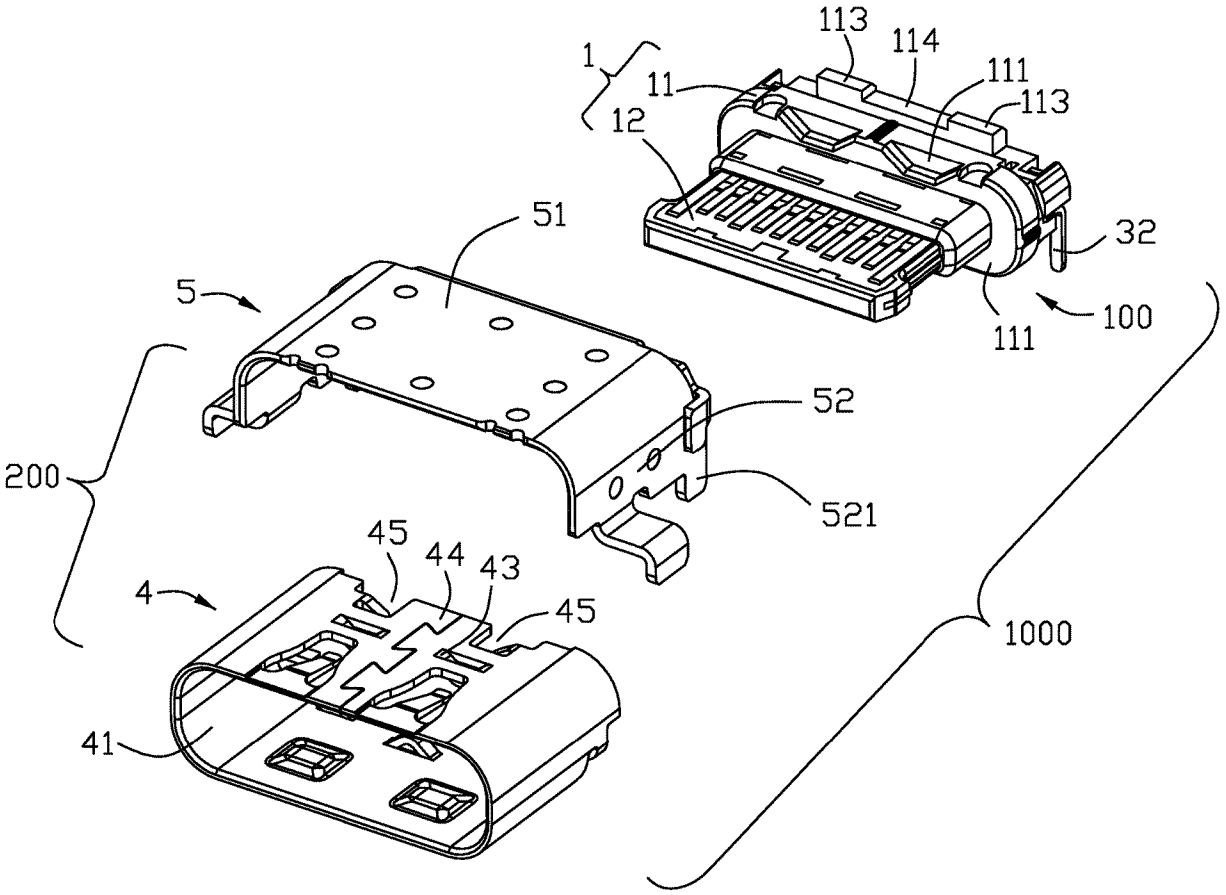
FIG. 3 is a front exploded view of the electrical connector.
Figure 4:
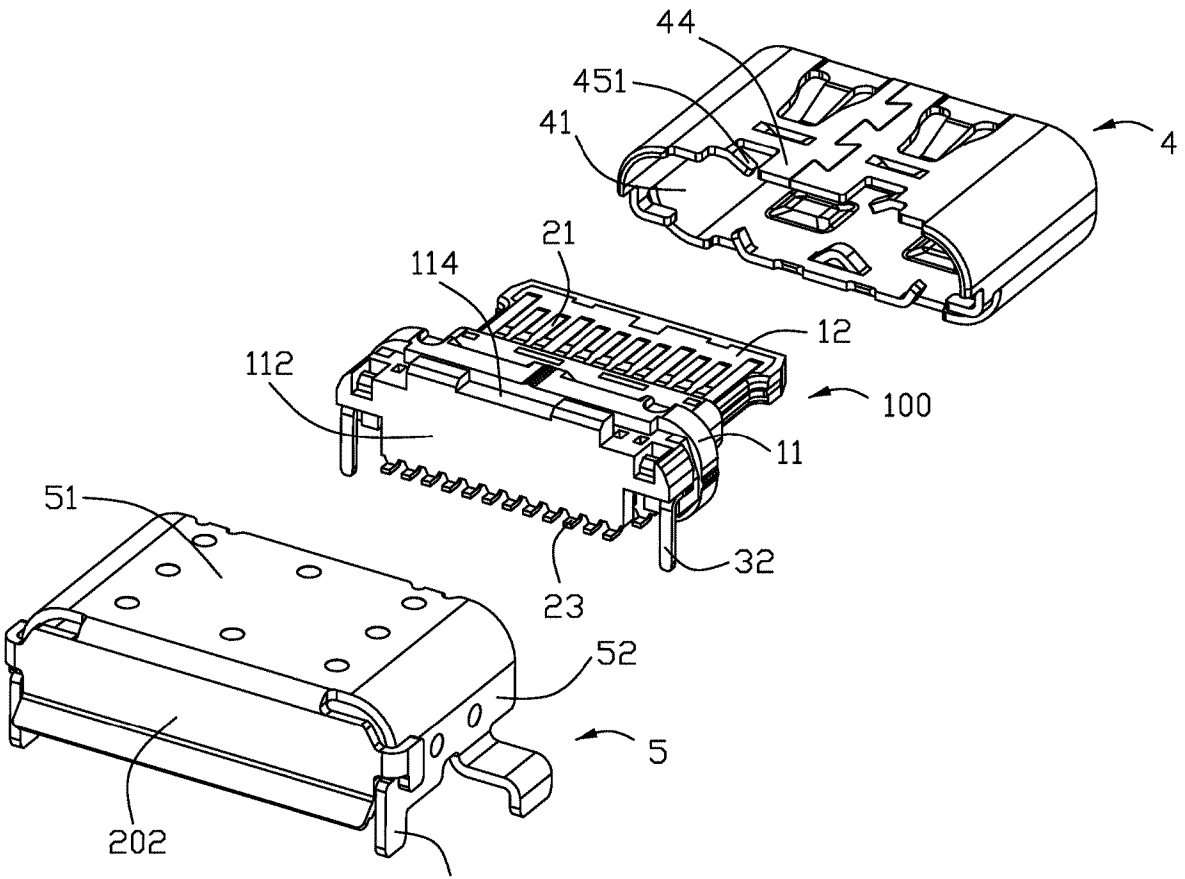
FIG. 4 is a rear exploded view of the electrical connector.
Figure 5:
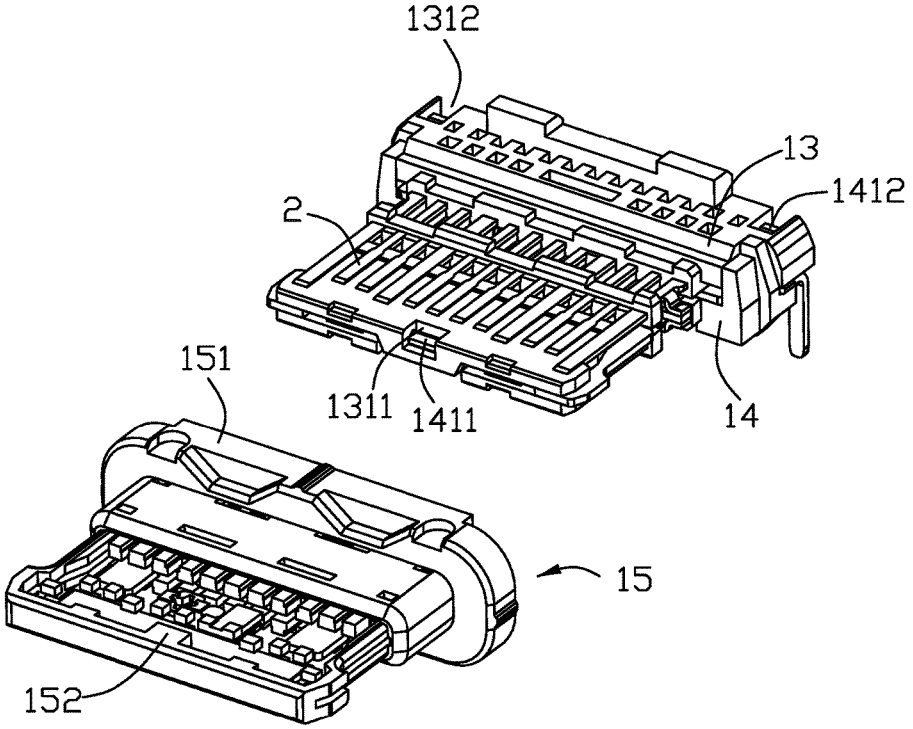
FIG. 5 is an exploded view of a contact module of the electrical connector.
Figure 6:
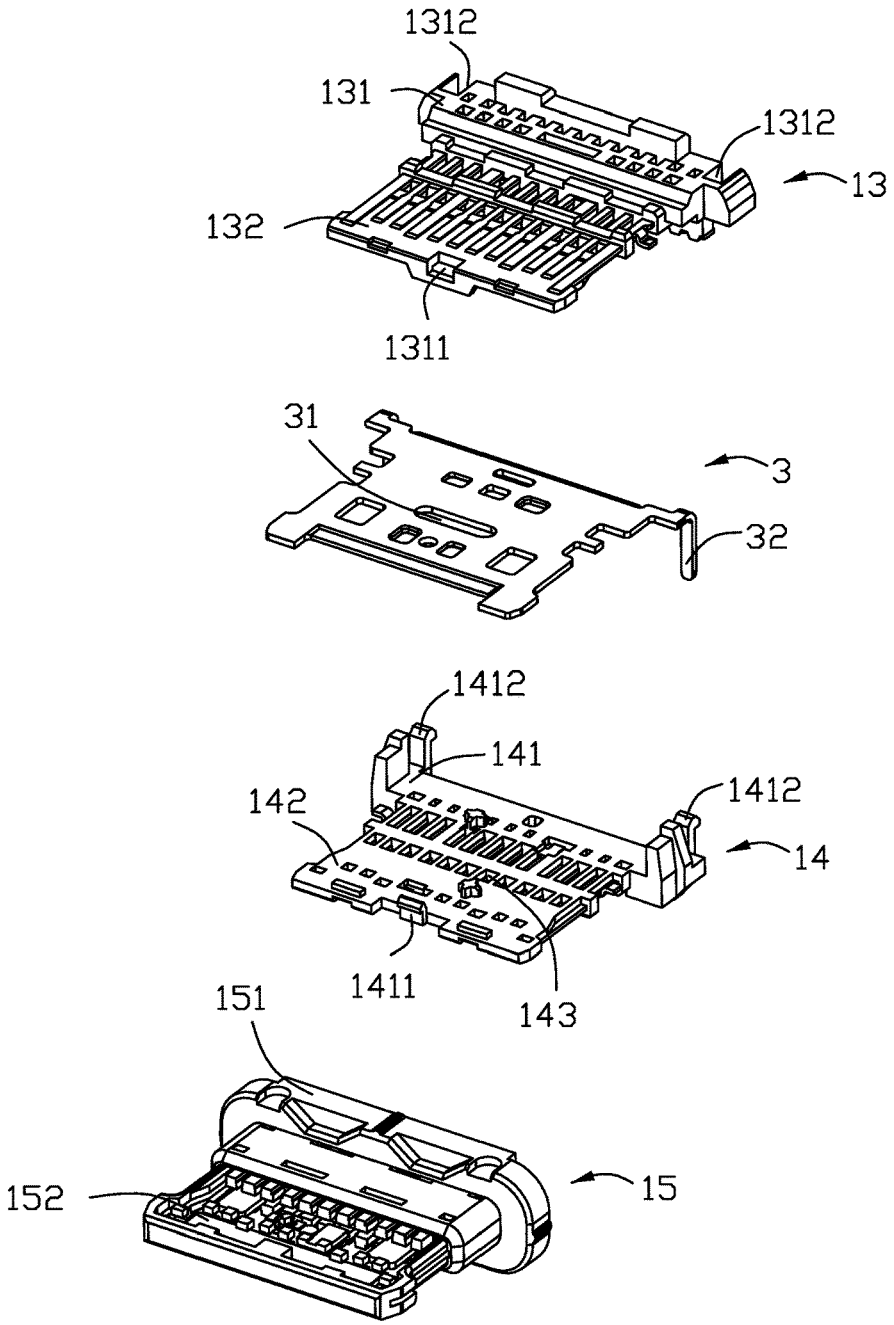
FIG. 6 is a further exploded view of the contact module.
Figure 7:
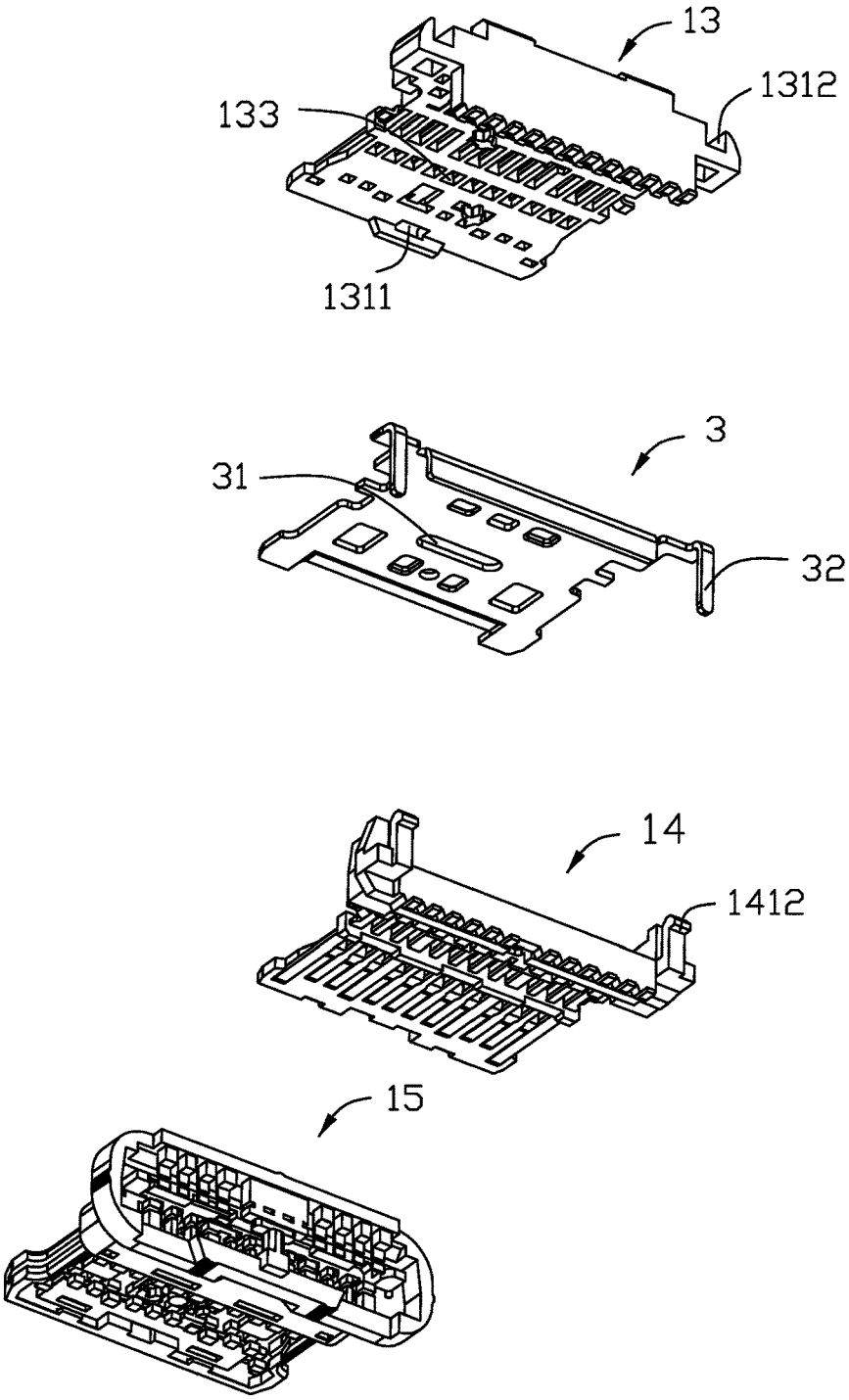
FIG. 7 is a rear exploded view of the contact module.

Referring specifically to FIGS. 1-3, the shielding shell 200 includes a tubular main body 201 enclosing the base 11 and the tongue 12 and a rear plate 202 shielding a rear face 112 of the base 11. Preferably, the shielding shell 200 includes an inner shield 4 forming the main body 201 and an outer cover 5 disposed on the outer cover 4 and forming the rear plate 202. The outer cover 5 includes an upper wall 51, two opposite side walls 52, and the rear plate 202 extending dowered from the upper wall 51. The upper and side walls 51 and 52 are secured to the outer cover 4 through spot welding.

The outer cover 4 has a receiving space 41 for accommodating the contact module 100. A mating room 42 is formed between the tongue 12 and the space 41. The base 11 has grooves 1111 at a front face 111 thereof for receiving protrusions 43 of the outer cover 4 which protrude forward beyond the front face 111 for protection purpose. The base 11 has two blocks 113 and a recess 114 therebetween and the outer cover 4 has corresponding notches 45 and tab 44. The outer cover 4 further has two fingers 451 in the notches 45.

Figure 8:
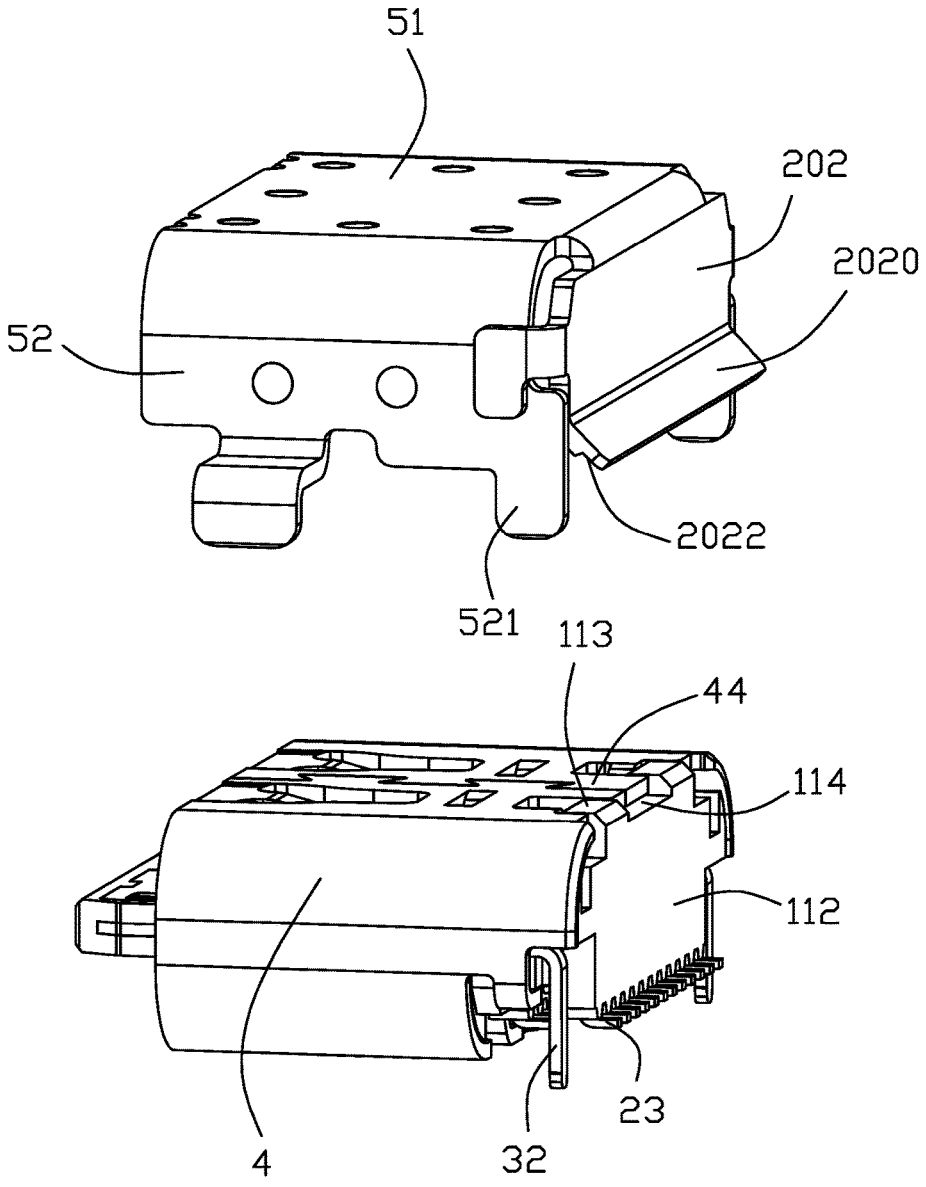
FIG. 8 is an exploded view showing a part of a shielding shell of the electrical connector not yet mounted.
Figure 9:
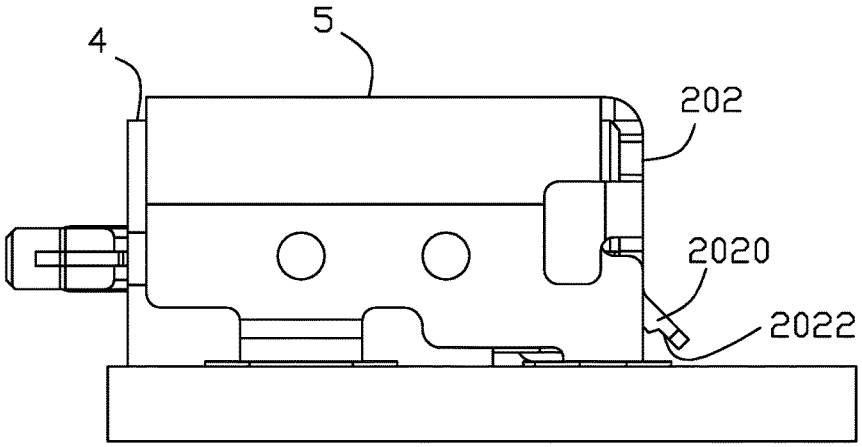
FIG. 9 is a side view of the electrical connector.
Figure 10:
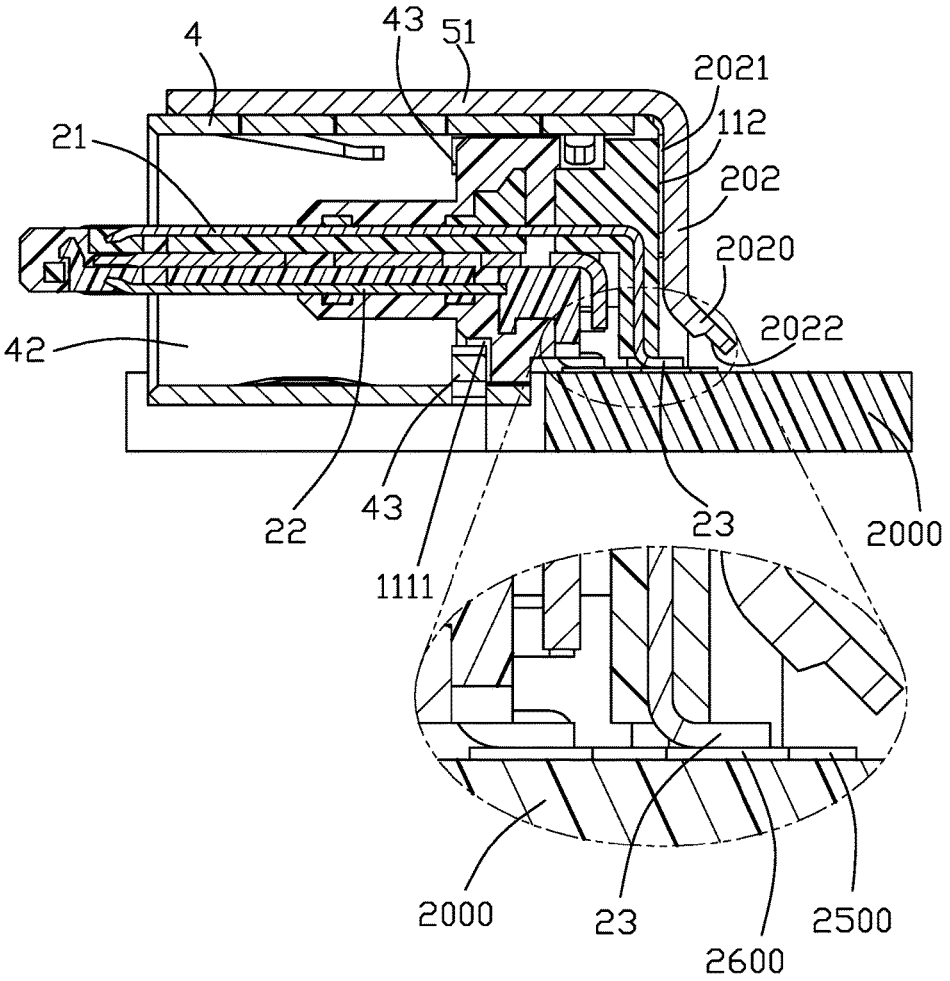
FIG. 10 is a cross-sectional view of the electrical connector taken along line A-A in FIG. 1.

Referring in conjunction with FIGS. 8-10, the rear plate 202 is bent to bear against or to extend along the rear face 112 of the base 11 to have a compact structure, which also prevents a rearward movement of the contact module 100.

At least one row of tails 23 of the contacts 2 in the first insulator 13 or the second insulator 14 extend rearward beyond the rear face 112 of the base 11. The rear plate 202 has a vertical upper part and an angled lower part, and has at an inner wall face 2021 thereof a recessed face 2022 opposing the contact tails 23 in order to increase a distance between the rear plate 202 and the contact tails 23. The rear plate 202 may have a thinned portion to form the recessed face 2022. The rear plate 202 may also have an angled portion 2020, and the thinned portion is disposed on the angled portion 2020. The middle grounding plate 3 if present has two soldering legs 32 immediately outwardly of the contact tails 23 and the side walls 52 of the outer cover 5 have soldering legs 521 flanking the soldering legs 32 to further improve shielding effect.

It is noted that the space in the cellular phone is limited and small as well as the printed circuit board used therein. The dimensions in the length, the width and height of the whole connector upon the connector are all mandatorily specified. It is not allowed to have the whole rear plate 202 to be located behind the contact tails 23 in a vertical manner. Therefore, the rear plate 202 can not help but have the angled portion 2020 delicately covering the contact tails 23 with a proper distance. In a microview, the end section of the contact tail 23 is terminated at a position under the vertical part of the rear plate 202, and the angled portion 2020 is intentionally outwardly/rearwardly bent to form an additional space covering/shielding said contact tail 23.

Notably, the angled portion 2020 essentially extends at a 45-degree and the lower free end of the angled portion 2020 is spaced from the printed circuit board wherein the recessed face 2022 is formed in an inner surface of the angled portion 2020 around the lower free end. In this embodiment, the conductive rim 2500 of the through hole 2550 in the printed circuit board 2000 extends rearwardly beyond the conductive pad 2600 on which the contact tail 23 is soldered. Therefore, as shown in FIG. 10, the rear edge of the angled portion 2020 is also rearwardly beyond the conductive rim 2500 in a top or side view.

In this embodiment, the through hole 2550 is to receive the soldering leg 521 of the shell 5 while the through hole 2555 is to receiving the soldering leg 32 of the grounding plate 3 wherein the through hole 2550 and the through hole 2555 are joined with each other as one large hole which the conductive rim 2500 surrounds. Understandably, the angled portion 2020 is located between the pair of soldering legs 521 also covering the through hole 2555 in the vertical direction. Notably, the height of the angled portion 2020 is around one third or one fourth of the height of the whole rear plate 202 in the vertical direction.

What is claimed is:

1. An electrical connector comprising:

a contact module including an insulative housing and an upper and lower rows of contacts arranged in the insulative housing, the insulative housing having a base and a tongue, the upper row of contacts and the lower row of contacts being exposed to two opposite surfaces of the tongue, respectively, each contact having a contacting portion, a tail, and an intermediate portion between the contacting portion and the tail; and a shielding shell enclosing the insulative housing, the shielding shell including a rear plate proximate to the contact tails; wherein the rear plate has a recessed face opposing the contact tails to increase a distance between the rear plate and the contact tails; and the rear plate has a thinned portion to form the recessed face.

2. The electrical connector as claimed in claim 1, wherein the rear plate has an angled portion, and the thinned portion is disposed on the angled portion.

3. The electrical connector as claimed in claim 1, wherein the shielding shell includes an inner shield and an outer cover, and the rear plate is disposed on the outer cover.

4. An electrical connector assembly comprising:

a printed circuit board forming a plurality of conductive pads arranged at least in one row along a transverse direction;

a contact module including an insulative housing with a plurality of contacts arranged in the insulative housing, each contact having a front contacting portion, a rear horizontally extending tail for surface mounting respectively upon the corresponding conductive pads, and an intermediate portion between the contacting portion and the tail along a front-to-back direction perpendicular to said transverse direction; and a shielding shell enclosing the insulative housing, the shielding shell including a rear plate proximate to the contact tails; wherein the rear plate has an angled portion at the lower free end to shield the horizontally extending tails in a slanted manner, and said angled portion downwardly faces the printed circuit board in a vertical direction perpendicular to both said transverse direction and said front-to-back direction.

5. The electrical connector assembly as claimed in claim 4, wherein the shielding shell includes a pair of soldering legs on two opposite sides in the transverse direction, and the angled portion is located therebetween in the transverse direction.

6. The electrical connector assembly as claimed in claim 5, wherein said printed circuit board forms corresponding through holes with corresponding conductive rims thereon respectively to receive the corresponding soldering legs, and the angled portion extends rearwardly beyond the conductive rims in a top view.

7. The electrical connector assembly as claimed in claim 6, wherein the connector further includes a grounding plate with a pair of soldering legs on two opposite sides along the transverse direction, and the soldering legs of the grounding plate intimately flank the soldering legs of the shielding shell.

8. The electrical connector assembly as claimed in claim 7, wherein the printed circuit board further include corresponding through holes to receive the corresponding soldering legs of the grounding plate, respectively, and the grounding hole receiving the soldering legs of the grounding plate are joined with the corresponding though hole receiving the soldering legs of the shielding shell to form a common one surrounded by the conductive rim.

9. The electrical connector assembly as claimed in claim 8, wherein the angled portion covers the through holes receiving the corresponding soldering legs of the grounding plate in the vertical direction.

10. The electrical connector assembly as claimed in claim 4, wherein the angled portion forms a recess in an inner surface around a lower free end in confrontation with the horizontally extending tails of the contacts.

11. The electrical connector assembly as claimed in claim 10, wherein the angled portion has a thinned section behind the recess.

12. The electrical connector assembly as claimed in claim 11, wherein said angled portion extends around a 45-degree.

13. The electrical connector assembly as claimed in claim 10, wherein said angled portion is spaced from the printed circuit board with a distance more than a thickness of the tail of the contact in the vertical direction.

14. The electrical connector assembly as claimed in claim 4, wherein a rear end of the horizontally extending tail of the contact is terminated under a vertical upper part of the rear plate and in front of the angled portion in a side view so as to have a sufficient distance from the rear plate.

15. An electrical connector for mounting to a printed circuit board, comprising:

a contact module including an insulative housing with a plurality of contacts retained in the insulative housing arranged in one row along a transverse direction, each contact having a front contacting portion, a rear horizontally extending tail for surface mounting respectively upon corresponding conductive pads on the printed circuit board, and an intermediate portion between the contacting portion and the tail along a front-to-back direction perpendicular to said transverse direction; and a shielding shell enclosing the insulative housing, the shielding shell including a rear plate proximate to the contact tails; wherein the rear plate has an angled portion at the lower free end to shield the horizontally extending tails in a slanted manner, and said angled portion downwardly faces the printed circuit board in a vertical direction perpendicular to both said transverse direction and said front-to-back direction.

16. The electrical connector as claimed in claim 15, wherein a rear end of the horizontally extending tail of the contact is terminated under a vertical upper part of the rear plate and in front of the angled portion in a side view so as to have a sufficient distance from the rear plate.

17. The electrical connector as claimed in claim 15, wherein a height of the angled portion is around one third or one fourth of a total height of the rear plate in the vertical direction.

18. The electrical connector as claimed in claim 15, wherein the angled portion extends around 45 degrees.

19. The electrical connector as claimed in claim 15, wherein a lower end of the angled portion is thinned compared with remainders.

* * * * *